United States Patent [19]

Sorensen et al.

[11] Patent Number: 4,660,444

[45] Date of Patent: Apr. 28, 1987

[54] HARDENING OF SELECTED AREAS OF AN EARTH BORING ROCKBIT

[75] Inventors: Robert K. Sorensen, Dallas; Starling Seaton, Midlothian, both of Tex.

[73] Assignee: Dresser Industries, Inc., Dallas, Tex.

[21] Appl. No.: 871,933

[22] Filed: Jun. 9, 1986

[51] Int. Cl.[4] ..... B21K 5/02; E21B 10/50; C21D 1/68

[52] U.S. Cl. ..... 76/108 A; 76/DIG. 2; 148/19; 384/95; 175/374

[58] Field of Search ..... 76/108 A, 108 R, DIG. 2, 76/101 E; 148/19; 175/329, 409, 411, 374; 384/92, 95

[56] References Cited

U.S. PATENT DOCUMENTS

| | | | |
|---|---|---|---|
| 2,367,978 | 1/1945 | Troy | 148/22.1 |
| 3,661,820 | 5/1972 | Foreman et al. | 260/22 A |
| 3,842,921 | 10/1974 | Dili et al. | 175/374 |
| 3,885,838 | 5/1975 | Childers et al. | 308/8.2 |
| 3,984,158 | 10/1976 | Sorensen et al. | 308/8.2 |
| 4,021,084 | 5/1977 | Garner | 308/8.2 |

*Primary Examiner*—Roscoe V. Parker

[57] ABSTRACT

Bearing surfaces or other selected areas of component parts of a rotary cone earth boring rockbit are carburized or otherwise surface enriched by the sequential steps of coating the selected surface area to be enriched with a non-water based composition capable of effecting a corrosive protective seal thereabout; covering the coated area with a predetermined applied thickness of a carbonaceous paste; drying the paste and thereafter, subjecting the component part to an elevated temperature below which the coating is pyrolyzed to fully austenize the part and achieve a desired case depth followed by quenching, tempering, and finished machining as required.

16 Claims, 3 Drawing Figures

HARDENING OF SELECTED AREAS OF AN EARTH BORING ROCKBIT

TECHNICAL FIELD

The technical field to which the invention pertains includes the field of earth boring equipment and more specifically to rotary cutter rockbits and metallurgical treatment therefor.

BACKGROUND OF THE INVENTION

The rotary rockbit and in particular the three coned bit is widely utilized in earth boring through geological formations for the drilling of water, oil and gas wells. It is well known in the art that such rockbits operate under extremely heavy loads and severe conditions of corrosion, temperature and abrasion. At the same time, the economics of petroleum production demand of such bits that they have a longer useful lifetime and improved performance since as is well known, the labor cost of replacing a worn or broken bit far exceeds the cost of the bit per se. This has led to improved materials and/or metallurgical treatments by which such goals have been substantially enhanced. By virtue of such improvements, failures have tended to increasingly become isolated to the bearing system about which the cutter element rotates relative to its support arm.

It will be appreciated that the precise operating conditions vary with the type of geological formation and properties of the bit being utilized. Whether operated under heavy load at high penetration rate or moderate load at relatively high speeds, the rockbits are subjected to a highly corrosive environment and temperature extremes. Since drilling is typically conducted thousands of feet underground, extreme temperature elevations are encountered for which a drilling fluid is continuously circulated to cool and flush the bit and carry away cuttings. The fluid per se contains a high content of water with added chemicals to control water loss or to control viscosity and/or PH factor. Some of these chemicals may result in a corrosive drilling fluid such that the drill cuttings, materials encountered in the earth formations, barites added for fluid weight control and/or the chemical composition of the drilling fluid combine to create a highly corrosive and abrasive drilling environment.

In recognition of the foregoing, considerable effort has been expended toward enhancing the bearing life in such rockbits. By and large such efforts have included metallurgical treatments whereby the bearing surfaces are characterized by increased endurance against wear and failure. For example, in U.S. Pat. No. 3,984,158 to Sorensen et al there is disclosed of a sintered bearing matrix compressed into the shape of the desired bearing element. An anti-galling material is infiltrated into the matrix which is then hardened to provide a bearing element having a hard wear resistant surface and areas of anti-galling material.

U.S. Pat. No. 3,885,838 to Childers et al discloses use of bearing surfaces which are selectively carburized and uncarburized to enhance wear resistance and to alleviate cracking respectively at controlled locations.

U.S. Pat. No. 4,021,084 to Garner discloses a construction in which either the solid journal bearing or its cooperating bearing support surface is provided with a body of hardened carburized steel. A plurality of mutually spaced apart shallow pockets extend from the bearing surface and are filled with a wear resistant material even harder than the hardened carburized steel and having low ductility.

Other patents, such as U.S. Pat. No. 3,842,921 to Dill et al describe various known metallurgical techniques for carburizing and boronizing of the rockbit cutter surfaces in contrast to the bearing surfaces thereof. Patents such as U.S. Pat. Nos. 2,367,978 to Troy and 3,661,820 to Foreman et al are non-rockbit related and more general in their disclosure of coating compositions for masking portions of metal from the effects of a treating composition.

While each of the above have contributed toward advances in the art, it will be appreciated that each is relatively complex and costly to implement. Yet to the extent they have been commercially utilized they have undoubtedly been justified on the basis of their contribution to the overall economic saving in the drilling system of which they have been a part. Despite recognition therefore of the need to further improve rockbit construction in order to enhance the economics of earth drilling, it has not heretofore been known how to effectively obtain the combination of significant cost reduction and enhanced operating performance in the bearing surface construction of a rotary rockbit.

SUMMARY OF THE INVENTION

This invention relates to rotary rockbits. More specifically, the invention relates to surface enrichment by selectively carbonitriding and heat treating surfaces of a rotary rockbit that represents the height of novelty in the relative cost and simplicity by which it is effected.

In accordance with an important aspect of the invention, the specific surface or selected area thereof to be carbonitrided and/or hardened is first cleaned thoroughly to remove any oil residues. If the metal to be carbonitrided is characterized by susceptibility to corrosion, a coating is then applied of a corrosively protective non-waterbase composition capable of being pyrolized, vaporized, carbonized or otherwise decomposed during the subsequent processing steps. Compositions suitable for that purpose are commercially available as an acrylic for aerosol application and marketed for example under the trademark KRYLON. After the coating has completely dried, a heavy layer of a carbonaceous paste containing significant amounts of ammonium hydroxide is suitably applied onto the selected areas. Such pastes are likewise commercially available, as for example, marketed under the trademark NITROCARB-PLUS. The paste is allowed to dry or may be dried in an oven or other means at temperatures between about 180° F. and 220° F. After drying, the affected selectively coated steel component part is placed in a neutral atmosphere furnace at temperatures sufficient to austenitize the part. While in the furnace, the initially applied coating is caused to pyrolyze, vaporize, carbonize or otherwise decompose thereby permitting the desired carbonitrided case depth to be attained. On being removed from the furnace, the part is subjected to hardening treatment, as by quenching in oil or other suitable quenching media, before being tempered to the desired case and core hardness. After tempering, the part is cleaned and prepared for such further manufacturing as is required.

By the above technique, an added hardness can conveniently and relatively inexpensively be selectively obtained on any steel surface requiring a hardness change from its otherwise natural state. In a preferred application, such a surface comprises a bearing for a rockbit whereby greater hardness and consequent longer service expectancy can be obtained than otherwise without interfering with the overall performance of such bits. The economic virtues thereof will be instantly apparent to those skilled in the art when compared with the more costly treatments available in accordance with similar purpose procedures of the prior art.

It is therefore an object of the invention to provide a novel method for carbonitriding steel surfaces.

It is a further object of the invention to effect the previous object by providing a method readily adapted to selected rockbit surface areas such as the bearing surface thereof.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
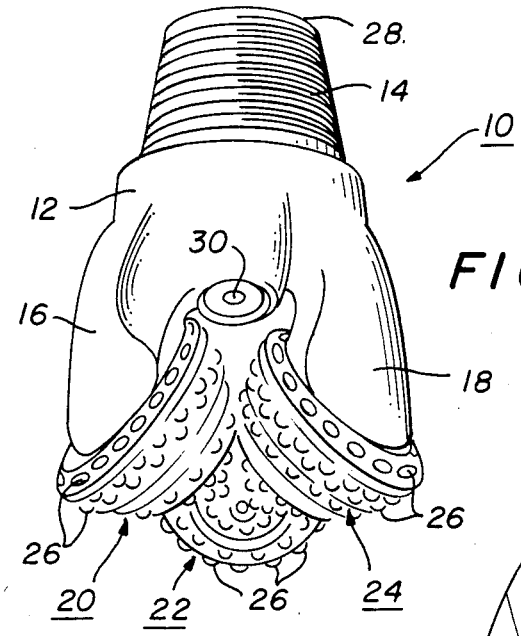
FIG. 1 is a pictorial view of a three coned rotary rockbit.

In the description which follows, like parts are marked throughout the specification and drawings with the same reference numerals respectively. The drawing figures are not necessarily to scale and in certain views parts may be drawn rotated to the plane of the drawing for clarity.

Referring now to FIG. 1, there is disclosed a three cone jet type rotary rockbit generally designated by the reference 10. Forming bit 10 is a body 12 including an upper threaded portion 14 which allows the bit to be connected to the lower end of a rotary drill string (not shown). Depending from body 12 are three substantially identical arms with two of the arms 16 and 18 being shown. Three rotary cone cutters 20, 22 and 24 are supported for rotation on three bearing pins extending from the arms as will be described. Each of the cutters includes a toothed cutting structure 26 on its outer surface adapted to disintegrate the earth formation as the bit is rotated and moved downward therethrough. As shown, cutting structures 26 comprise a form of tungsten carbide insert although it should be understood that other known cutting structures such as steel teeth, may be used in the alternative.

Formed internally of bit 10 is a central passageway 28 extending vertically along the central axis of body 12 allowing drilling fluid to enter from the drill string and be passed downward through nozzles 30 to the bottom of the well bore. In use, bit 10 is connected as a lower member of a rotary drill string and lowered into the well bore until the cone cutters 20, 22 and 24 engage the bore bottom. At that time, rotation of the drill string and attached bit 10 is initiated. This causes cutters 20, 22 and 24 to rotate on their respective bearing pins while drilling fluid is forced downward through the interior passage of the rotary drill string until passing outward of nozzle 30. Emerging from the nozzle, the drilling fluid is forced to the bottom of the well bore from which it is forced upwardly in the annulus between the rotary drill string and the wall of the well bore to the earth surface thereat.

Figure 2:
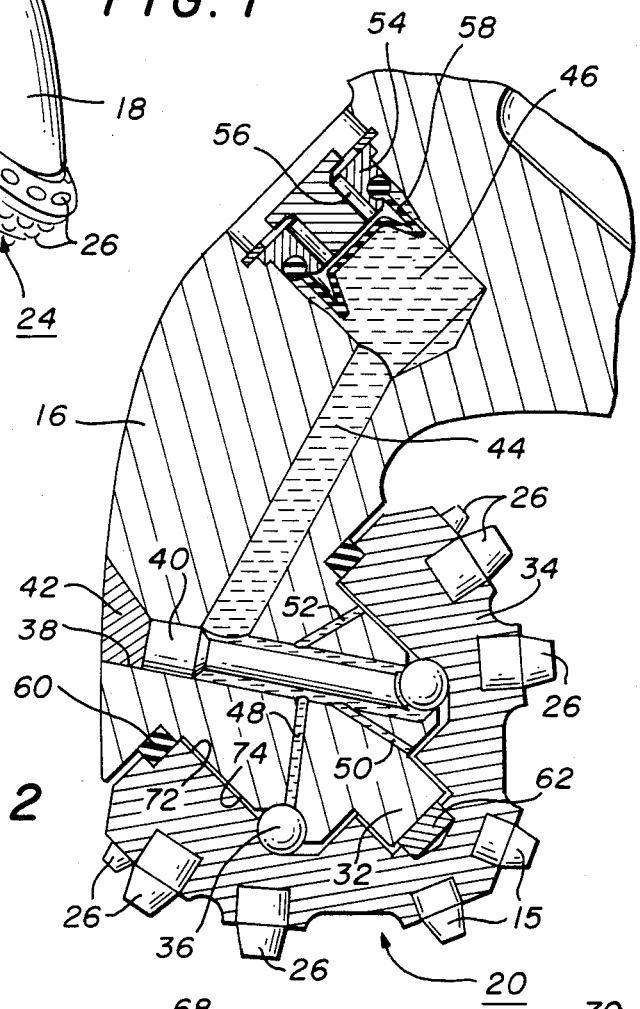
FIG. 2 illustrates one third of a three coned rotary rockbit, incorporating a bearing as may be metallurgically processed in accordance with the present invention.

As shown in the sectional view of FIG. 2, the arm 16 of rockbit 10 incorporates a bearing system the surface of which will be subjected to the surface enriching treatment in accordance herewith. The bit is adapted for connection to a rotary drill string and operates in the manner previously described. The elongated lower portion of arm 16 forms a journal 32 while the inwardly cooperating shell surface 34 of cutter 20 is mounted on journal 32 for rotation. Positioned on the exterior surface of cutter 20 are the cutting structures 26 which in the embodiment being described comprises a series of tungsten carbide inserts. As the bit is rotated, the inserts contact and disintegrate the penetrated formations to form the earth bore hole as is well known.

The bearing system, as will be appreciated, is required to afford free rotation for the rotatable cutters 20, 22 and 24 under the most severe of operating conditions. For that purpose, a series of ball bearings 36 insure that shell 34 is rotatably secured on journal 32 and to effect an interlock the ball bearings 36 are inserted through a bore 38 extending into the arm 16. With the ball bearings in place, a plug 40 is inserted into bore 38 and secured thereat by a weld 42.

Journal 32 and arm 16 in this embodiment are provided with a passage 44 for conducting lubricant from a reservoir 46 to intervening between the various bearing surfaces. Passage 44 intersects bore 38 and plug 40 at a reduced diameter in this area to allow the lubricant to be channeled to the bearings via additional passages 48, 50 and 52. The lubricant for these purposes will typically contain entrained particles of anti-galling material and a cap 54 is locked in place to retain the lubricant in reservoir 46. A passage 56 communicates the interior of reservoir 46 with the outside of the bit in allowing pressure equalization while preventing pressure differentials from potentially damaging the bearing system. The flexible diaphragm 58 serves to hold the lubricant in position while at the same time provides compensation for any potential changes in pressure. A flexible seal 60, intervening between shell 34 and arm 16 forms a seal thereat to prevent loss of lubricant or contamination of the lubricant from materials in the well bore. A thrust button 62 is positioned locked on the nose of shell 34 for withstanding the stress forces encountered during the drilling operation.

Figure 3:
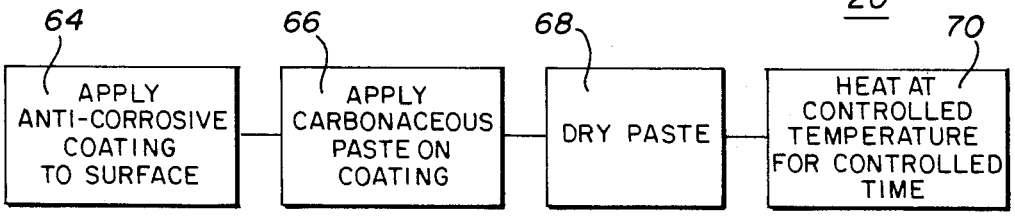
FIG. 3 is a block diagram for carrying out the primary steps of carbonitriding selected surface areas of the rockbit in accordance with the invention.

Referring now to the block diagram of FIG. 3 there is represented the four primary steps of surface enriching a steel surface in accordance herewith and designated 64, 66, 68 and 70. Whereas the method hereof can be regarded as applicable to any selected area for which carbonitriding will afford an operational advantage, for the purposes of disclosure and in the preferred embodiment such surfaces will be regarded as the steel journal bearing surface 72 of cutter unit 20 and the cooperating steel support surface 74 of arm 16.

Preliminary to performing the method hereof, the area to be selected, which in this instance is represented by bearing surfaces 72 and 74, are preferably cleaned either by a vapor degreasing or sand blasting to remove any oil residues as would adversely affect and preclude the subsequent process steps from being successfully performed. Once the surface area has been appropriately cleaned, a corrosion protective seal, as represented by block 64, is applied to the surfaces 72 and 74. For reasons as will be understood, the seal composition is of a non water base having the property of a pyrolyzing, vaporizing, or otherwise decomposing at a temperature to be encountered in a subsequent step of the process. Suitable as a coating for this purpose is an acrylic material marketed under the trademark KRYLON and available as an aerosol spray for application to the selected bearing surfaces areas to be processed.

The KRYLON product is manufactured by a division of Borden Chemical in Columbus, Ohio. In a fact sheet provided by the manufacturer it is available as Nos. 1301, 1302 and 1304 said to be identical and characterized as a water resistant acrylic resin coating subject to decomposing at temperatures of 450° F. It is also available as KRYLON Crystal Clear No. 150 that can be applied by spray, brush, dipping or wiping. When applied either by aerosol or as aforesaid, the KRYLON enables a complete and thorough coating to be formed free of pin holes. Being continuous without interruption it is readily able to protect the underlying metal against moisture effects by which pitting and corrosion could otherwise occur from the carbonaceous paste applied subsequently. Such coatings at normal room temperatures require approximately 2–5 minutes to adequately dry for purposes hereof.

After drying of the coating and for providing the carbon source, a heavy layer of carbonaceous paste is applied as represented by block 66 to the selected surface area to be processed. Such pastes are commercially available under the trademark NITROCARB-PLUS marketed by the Middle States Oil Co. of Westlake, Ohio and believed to comprise a composition containing carbon source such as charcoal and significant amounts of ammonium hydroxide. Promotional literature from the manufacturer characterized the composition as affording SAE 1018 steel a 50–62 Rc hardness to a depth of 0.030 inches and a total case depth of approximately 0.044 inches when held at 1700° F. for ninety minutes. In a preferred method, the paste is applied by positioning a metal ring or form about the surface area to which the paste is to be applied and filling the form with paste to provide a uniform thickness in the range of about ⅜ inch to about one-half inch. When applied, the paste can be readily dried in an oven or elsewhere as represented by block 68 in about 3–5 hours at temperatures of about 200° F.

After drying, the pasted part is placed in a neutral atmosphere furnace at a controlled temperature and for a controlled time period. For the embodiment being described about 1550° F. and approximately four hours respectively is utilized to produce a case depth of about 0.030 inches. This can obviously be varied to suit depending on the ultimate case depth desired. During this step, represented by block 70, the previously applied KRYLON coating is decomposed while moisture in the paste is removed.

On removing the parts from the furnace, they are quenched in oil or other suitable quenching media before being tempered to the desired case and core hardness. This results in a Rockwell C hardness of between about 56–65 as compared to a Rockwell C of between about 20–45 in the adjacent non-treated areas.

On completion of the latter, the parts are cleaned and prepared as necessary for further manufacturing. For example the previously carbonitrided bearing surface would be ground smooth to a finished dimension with minimal surface removal in order to retain the effect of the applied carbonitriding. An ultimate bearing hardness of approximately 56 to 65 Rockwell C is preferred for these purposes and is readily obtained by the step sequences described.

By the above description there is disclosed a novel process for hardening selective steel surfaces where required as in the case of the three cone rotary bit of the preferred embodiment. It obviously could be utilized on other parts when shallow case is desired. The process is relatively simple and uncostly as compared to similar purpose hardening techniques of the prior art and yet achieves a completely satisfactory end product of quality equal if not more suitable for the task to be performed thereby. Whereas the bearing surface is represented in the preferred embodiment for purposes of disclosure, it should be apparent that the invention could be applied elsewhere where required on a rotary bit or used in an abundance of applications for a variety of different and unrelated type metal structures. The advantages afforded thereby will be readily appreciated by those skilled in the art in achieving a novel structure by a method representing the height of simplicity as compared to what has previously been utilized for achieving such purposes.

Since many changes could be made in the above construction and many apparently widely different embodiments of this invention could be made without departing from the scope thereof, it is intended that all matter contained in the drawings and specification shall be interpreted as illustrative and not in a limiting sense.

We claim:

1. A method of surface-enriching a metal surface by application to said surface of a surface-enriching material and wherein said surface is susceptible to corrosion by said material in the as-applied condition comprising the steps of:

(a) applying a protective coatig onto the metal surface to be enriched, said coating being effective to prevent direct contact of said material with said surface as applied, but permitting such contact at an elevated surface-enriching temperature;

(b) applying over said coating a predetermined quantity of said material; and (c) heating said surface and material for a controlled time period to a predetermined elevated temperature sufficient to cause said material to become non-corrosive and expose said surface directly to said enriching material and to effect a desired case depth of enrichment on said surface from said material.

2. The method in accordance with claim 1 in which said material comprises a water-based carbonaceous paste and said coating is a non-water based protective coating and wherein said paste is dried to a non-corrosive condition prior to said coating permitting contact between said surface and said material.

3. The method in accordance with claim 2 wherein said coating is pyrolyzed or vaporized prior to said surface attaining said predetermined temperature but subsequent to said paste being dried.

4. The method in accordance with claim 3 in which the surface to be enriched is precleaned prior to said coating being applied in said coating application step.

5. The method in accordance with claim 2 in which said coating is applied as a wetted composition and is permitted to dry before application of the paste thereon in said paste application step.

6. The method in accordance with claim 5 in which said coating is of an acrylic composition and is applied in said coating application step in aerosol form.

7. The method in accordance with claim 6 in which said paste is of a carbonaceous and ammonia composition and is permitted to dry before being subjected to said elevated temperature.

8. The method in accordance with claim 7 in which the metal surface to be carburized comprises a bearing surface adapted to be positioned opposite a relatively movable component supported thereat in a bearing relation.

9. The method in accordance with claim 8 in which said bearing surface comprises the surface of a journal bearing of an earth boring rockbit.

10. A method of surface-enriching a selected metal surface area of an earth boring rockbit by application to said surface of a surface-enriching material wherein said surface is susceptible to corrosion by said material in the as-applied condition and in which the rockbit comprises component parts including a body adapted for mounting onto the under end of a drill string and a rotatable cutter supported for rotation on said body, said method comprising the steps of:

(a) applying a protective coating onto the metal surface to be enriched, said coating being effective to prevent direct contact of said material with said surface as applied, but permitting such contact at an elevated surface-enriching temperature;

(b) applying over said coating a predetermined quantity of said material; and (c) heating said surface and material for a controlled time period to a predetermined elevated temperature sufficient to cause said material to become non-corrosive and expose said surface directly to said enriching material and to effect a desired case depth of enrichment on said surface from said material.

11. The method in accordance with claim 10 in which said material comprises a water-based carbonaceous paste and said coating is a non-water based protective coating and wherein said paste is dried to a non-corrosive condition prior to said coating permitting contact between said surface and said material.

12. The method in accordance with claim 11 wherein said coating is pyrolyzed or vaporized prior to said surface attaining said predetermined temperature but subsequent to said paste being dried.

13. The method in accordance with claim 12 in which said coating is applied as a wetted composition and is permitted to dry before application of the paste thereon in said paste application step.

14. The method in accordance with claim 13 in which said cutter is supported for rotation on said body in a bearing relation thereto and the selected surface to be enriched comprises at least one of the cooperating bearing surfaces between said cutter and said body.

15. The surface product formed by the method of claim 1.

16. A rockbit containing the surface product formed by the method of claim 10.

* * * * *